US012702894B2

(12) United States Patent
Andreassen et al.

(10) Patent No.: US 12,702,894 B2
(45) Date of Patent: Aug. 11, 2026

(54) GAPLESS HINGE FOR ADJUSTABLE WEIGHT BENCH

(71) Applicant: Mythic Equipment LLC, Arvada, CO (US)

(72) Inventors: Sean Matthew Andreassen, Arvada, CO (US); Madison Hart Copeland, Arvada, CO (US)

(73) Assignee: Mythic Equipment LLC, Arvada, CO (US)

( * ) Notice: Subject to any disclaimer, the term of this patent is extended or adjusted under 35 U.S.C. 154(b) by 58 days.

(21) Appl. No.: 18/922,535

(22) Filed: Oct. 22, 2024

(65) Prior Publication Data

US 2025/0135264 A1 May 1, 2025

Related U.S. Application Data

(60) Provisional application No. 63/593,720, filed on Oct. 27, 2023.

(51) Int. Cl.
*A63B 21/00* (2006.01)

(52) U.S. Cl.
CPC ..... *A63B 21/4029* (2015.10); *A63B 2225/09* (2013.01)

(58) Field of Classification Search
CPC ..... A63B 21/4029; A63B 2225/09; A63B 21/078
See application file for complete search history.

(56) References Cited

U.S. PATENT DOCUMENTS

| | | | |
|---|---|---|---|
| 4,765,616 | A | 8/1988 | Wolff |
| 5,860,701 | A | 1/1999 | Jungjohann et al. |
| 5,882,283 | A | 3/1999 | Stevens |
| 6,605,023 | B1 | 8/2003 | Mobley |
| 7,331,913 | B2 | 2/2008 | Forcillo |
| 10,589,144 | B2 | 3/2020 | Specht et al. |
| 10,940,950 | B2 | 3/2021 | Bang et al. |
| 11,700,947 | B1 | 7/2023 | Rodriguez |
| 2022/0176190 | A1 | 6/2022 | Pena et al. |

FOREIGN PATENT DOCUMENTS

| | | |
|---|---|---|
| CN | 202122337 U | 1/2012 |

OTHER PUBLICATIONS

AB-5000 Zerogap Adjustable Bench | Rep Fitness, https://repfitness.com/collections/benches/products/ab-5000-zero-gap-adjustable-bench, Retrieved: Aug. 28, 2023, 3 pgs.

*Primary Examiner* — Sundhara M Ganesan
(74) *Attorney, Agent, or Firm* — BEKIARES ELIEZER LLP

(57) ABSTRACT

A weight bench may include a frame, a seat portion, and a back rest portion. The seat and back rest portions may be mounted to the frame using a hinge, allowing rotation between flat and inclined positions. The hinge may include first and second sliding limit hinges for the seat and back rest portions respectively. The seat and back rest portions may substantially abut along a common axis, with a gap of approximately zero. The sliding limit hinges may maintain a constant gap width as the portions rotate between positions. This configuration may allow for smooth adjustment while maintaining a seamless bench surface.

20 Claims, 17 Drawing Sheets

GAPLESS HINGE FOR ADJUSTABLE WEIGHT BENCH

RELATED APPLICATION

Under provisions of 35 U.S.C. § 119(e), the Applicant claims benefit of U.S. Provisional Application No. 63/593,720 filed on Oct. 27, 2023, and having inventors in common, which is incorporated herein by reference in its entirety.

It is intended that the referenced application may be applicable to the concepts and embodiments disclosed herein, even if such concepts and embodiments are disclosed in the referenced application with different limitations and configurations and described using different examples and terminology.

FIELD OF DISCLOSURE

The present disclosure generally relates to adjustable benches, and more specifically to adjustable weight benches.

BACKGROUND

In some situations, adjustable weight benches may have a gap between the pads of different sections of the bench. In particular, the gap may vary in size depending on the orientation of the sections of the bench. For example, the gap may be minimal when the bench is in an upright configuration and may be larger when the bench is in a flat configuration. This gap can introduce some amount of discomfort and/or distraction when a user is relying on the weight bench for support.

In particular, existing designs pivot about single or double axis hinges, with the hinge mechanism as the pivot point of the structure. These mechanisms necessarily introduce a gap in the padding, as the pivot point is not flush with the padding surface. In some cases, the bench may further incorporate a sliding mechanism, separate from the hinge, to close the gap between the pads as a secondary mechanism. These mechanisms introduce additional mechanical failure points, as well as making the bench heavier and more susceptible to unexpected movement or instability.

Accordingly, there is a need for a weight bench that allows for one or more sections of the bench to be adjustable by rotation about an axis, while maintaining a consistent and minimal gap between padding on the weight bench sections.

Brief Overview

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

A weight bench includes a frame, a seat portion mounted to the frame using a hinge, such that the seat portion is rotatable between a flat position and an inclined position, and a back rest portion mounted to the frame using the hinge, such that the backrest portion is rotatable between a flat position and an inclined position. The backrest portion and the seat portion are mounted to the frame by the hinge such that a peripheral edge of an upper surface of the seat portion substantially abuts a peripheral edge of an upper surface of the backrest portion to define a common axis, such that a gap between the seat portion and the backrest portion is approximately zero. The hinge includes a first sliding limit hinge configured to allow the seat portion to rotate about the common axis, and a second sliding limit hinge configured to allow the backrest portion to rotate about the common axis. The first sliding limit hinge maintains the gap between the seat portion and the backrest portion at a constant width as the seat portion rotates between the flat position and the inclined position. The second sliding limit hinge maintains the gap between the seat portion and the backrest portion at a constant width as the backrest portion rotates between the flat position and the inclined position.

In various embodiments, a weight bench may include a first portion (e.g., a seat portion) and a second portion (e.g., a backrest portion) that are adjustably mounted to a support, such that both the seat portion and the backrest portion are rotatable about a common adjustment axis.

In embodiments, the adjustment axis may be defined as a line where the upper surface of the padding of the seat portion meets the upper surface of the padding of the backrest portion. Setting the adjustment axis at this point allows for a minimal (e.g., substantially 0) gap between the padding of the seat portion and the padding of the backrest portion, while still providing a full range of motion for both portions of the weight bench. Thus, the hinge is designed to locate the point of rotation at the edge of both the seat pad and the backrest pad.

In embodiments, the adjustment axis may be defined as a line where the upper surface of the padding of the seat portion may meet the upper surface of the padding of the backrest portion. Setting the adjustment axis at this point may allow for a minimal gap between the padding of the seat portion and the padding of the backrest portion, while still providing a full range of motion for both portions of the weight bench. Thus, the hinge may be designed to locate the point of rotation at the edge of both the seat pad and the backrest pad.

The weight bench may include a frame. A seat portion may be mounted to the frame using a hinge, such that the seat portion may be rotatable between a flat position and an inclined position. A back rest portion may be mounted to the frame using the hinge, such that the backrest portion may be rotatable between a flat position and an inclined position. The backrest portion and the seat portion may be mounted to the frame by the hinge such that a peripheral edge of an upper surface of the seat portion may substantially abut a peripheral edge of an upper surface of the backrest portion to define a common axis, such that a gap between the seat portion and the backrest portion may be approximately zero.

The hinge may include a first sliding limit hinge configured to allow the seat portion to rotate about the common axis. The hinge may include a second sliding limit hinge configured to allow the backrest portion to rotate about the common axis. The first sliding limit hinge may maintain the gap between the seat portion and the backrest portion at a constant width as the seat portion rotates between the flat position and the inclined position. The second sliding limit hinge may maintain the gap between the seat portion and the backrest portion at a constant width as the backrest portion rotates between the flat position and the inclined position.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
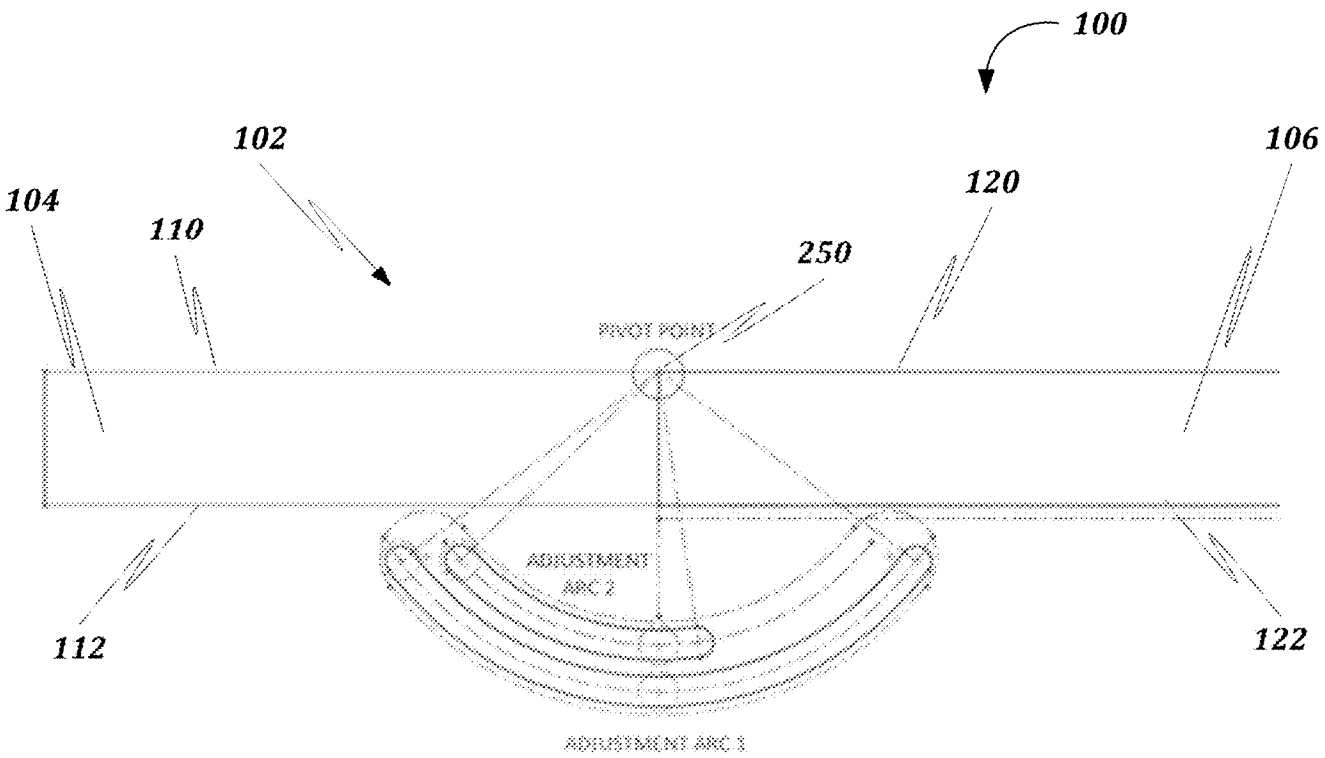
FIG. 1 illustrates a block diagram of a hinge for use in a weight bench.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely to provide a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such a term to mean based on the contextual use of the term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

The present disclosure includes many aspects and features. Moreover, while many aspects and features relate to, and are described in, the context of a gapless hinge for use in a weight bench, embodiments of the present disclosure are not limited to use only in this context.

I. Platform Overview

This overview is provided to introduce a selection of concepts in a simplified form that are further described below. This overview is not intended to identify key features or essential features of the claimed subject matter. Nor is this overview intended to be used to limit the claimed subject matter's scope.

In embodiments, a weight bench 100 may include a support surface 102, divided into seat section 104, referred to interchangeably as a first section or a front section, and a backrest section 106, referred to interchangeably as a back section or a second section. The weight bench 100 may also include a hinge 170 configured to allow both the seat section 102 and the backrest section 104 to rotate about a common axis. The hinge 170 is designed to locate the axis of rotation 250 away from the hinge, at the edge of the pads where the seat section 102 meets the backrest section 104. In this way, both the seat section 102 and the backrest section 104 are free to rotate about the axis of rotation 250 This is illustrated in FIG. 1, which shows the axis of rotation 250 as the "PIVOT POINT" and the hinge 170 describing arced paths of travel for each the seat portion 102 and backrest portion 104 pads as "ADJUSTMENT ARC 1" and "ADJUSTMENT ARC 2", respectively.

Embodiments of the present disclosure may comprise methods, systems, and a computer readable medium comprising, but not limited to, at least one of the following:

A. A Support Surface

B. A Base

C. A Hinge

Details with regard to each module are provided below. Although modules are disclosed with specific functionality, it should be understood that functionality may be shared between modules, with some functions split between modules, while other functions duplicated by the modules. Furthermore, the name of each module should not be construed as limiting upon the functionality of the module. Moreover, each component disclosed within each module can be considered independently, without the context of the other components within the same module or different modules. Each component may contain functionality defined in other portions of this specification. Each component disclosed for one module may be mixed with the functionality of other modules. In the present disclosure, each component can be claimed on its own and/or interchangeably with other components of other modules.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

II. Configuration

Embodiments of the present disclosure provide a weight bench 100 that includes a support surface 102, a base 140, and a hinge 170.

A. A Support Surface

The weight bench 100 may include a support surface 102 that is divided into a seat portion 104 and a backrest portion 106. In embodiments, the seat portion 104 and the backrest portion may be configured to rotate independently about a single axis of rotation 250 defined by the hinge 170.

The seat portion 104 may include an upper surface 110 that is padded for user comfort. As examples, the upper surface 110 may be formed from foam rubber, a memory foam material, polyvinyl chloride (PVC), cotton, and/or other materials that provide support and cushion to a user. The seat portion 104 may include a lower surface 112 for providing support for the user and provide an interface between the seat portion 104 and the base 140 and/or the hinge 170. In embodiments, the lower surface 112 may be formed from metal, such as cast iron or stainless steel, wood, plastic, and/or other substantially rigid materials. In embodiments the seat portion 104 may include a seat position member 114 configured to interface with the base 140 to lock the seat portion 104 into one of a plurality of orientations. About the axis 250. As shown in FIGS. 5-10 and 14-16, there are four selectable orientations, but those of skill in the art will recognize that more or fewer selectable orientations are possible without departing from the scope of the invention.

The backrest portion 106 may include an upper surface 120 that is padded for user comfort. As examples, the upper surface 120 may be formed from foam rubber, a memory foam material, polyvinyl chloride (PVC), cotton, and/or other materials that provide support and cushion to a user. The backrest portion 106 may include a lower surface 122 for providing support for the user and provide an interface between the backrest portion 106 and the base 140 and/or the hinge 170. In embodiments, the lower surface 122 may be formed from metal, such as cast iron or stainless steel, wood, plastic, and/or other substantially rigid materials. In embodiments the backrest portion 106 may include a backrest position member 124 configured to interface with the base 140 to lock the backrest portion 106 into one of a plurality of orientations. About the axis 250. As shown in FIGS. 5-10 and 14-16, there are 10 selectable orientations, but those of skill in the art will recognize that more or fewer selectable orientations are possible without departing from the scope of the invention.

The support surface 102 may include a lower surface 112 for providing support for the user and providing an interface between the support surface 102 and the base 140 and/or the hinge 170. In embodiments, the lower surface 112 may be formed from metal, such as cast iron or stainless steel, wood, plastic, and/or other substantially rigid materials. The lower surface 112 may provide structural integrity to the support surface 102 and allow it to withstand the forces applied during exercise.

In some embodiments, the lower surface 112 may include reinforcing structures or ribbing to enhance its strength and rigidity. The lower surface 112 may be shaped to complement the contours of the upper surface 110, providing consistent support across the entire support surface 102.

The lower surface 112 may include mounting points or attachment mechanisms for securing the support surface 102 to the base 140 and/or hinge 170. These may include bolt holes, slots, brackets, or other fastening means that allow for secure attachment while potentially enabling some adjustability in positioning.

The material and construction of the lower surface 112 may be selected to provide a balance of strength, weight, and cost-effectiveness. For example, a lightweight yet strong aluminum alloy may be used to reduce the overall weight of the bench while maintaining structural integrity.

In some implementations, the lower surface 112 may feature a textured or coated finish to enhance grip when interfacing with other components of the weight bench 100. This may help prevent slippage or unwanted movement during use or adjustment of the bench.

The lower surface 112 may be designed with considerations for manufacturability and assembly. It may incorporate features that facilitate easy attachment of padding or upholstery to create the upper surface 110, as well as straightforward integration with the hinge 170 and base 140 components.

B. A Base

The weight bench 100 may include a base 140 configured to connect to the support surface 102. The base may be formed from a durable strong material, such as metal (e.g., stainless steel, composite steel, cast iron, etc.) and/or any other material capable of supporting the weight of the bench 100, a user, and weights (e.g., dumbbells, barbells, and/or other weighted objects a user may interact with).

As shown in FIGS. 5-10 and 14-16, the base 140 may include a frame 142 that is substantially angular in shape, having a first leg 144 that contacts the ground at a front of the bench 100, a second leg 146 that contacts the ground at a second end near a rear of the bench, and a center portion 148 that interfaces with the hinge 170. The frame 140 may also include a secondary support 150 for supporting the backrest in a flat position.

The first leg of the frame 144 may include an adjustable seat interface 152 for receiving and retaining the seat position member 114. The adjustable seat interface 152 may include a plurality of positioning guides for retaining the seat portion 104 in any one of the plurality of orientations about the axis 250. The second leg of the frame 146 may include an adjustable backrest interface 154 for receiving and retaining the backrest position member 124. The adjustable backrest interface 154 may include a plurality of positioning guides for retaining the backrest portion 106 in any one of the plurality of orientations about the axis 250.

In some embodiments, the frame 142 may be constructed from tubular metal components welded or otherwise fastened together to form a rigid structure. The tubular components may be made of steel, aluminum, or other suitable metals or alloys that provide strength and durability. The frame 142 may be designed to withstand the forces and loads typically encountered during weightlifting exercises.

The center portion 148 of the frame 142 may include mounting points or brackets for attaching the hinge 170. These mounting points may be reinforced to handle the stresses placed on the hinge during adjustment and use of the bench. The center portion 148 may also incorporate additional structural elements to enhance the overall stability of the bench.

The secondary support 150 may be a fold-out leg or brace that can be deployed to provide additional support when the backrest portion 106 is in a flat position. This secondary support 150 may be rotatably attached to the frame 142. In embodiments, the secondary support may include a locking mechanism (not shown) to secure the secondary support in place when deployed.

The adjustable seat interface 152 and/or the adjustable backrest interface 154 may incorporate a series of notches, holes, or other engagement features that correspond to different angle positions for the seat portion 104 and/or the backrest portion 106 respectively. These interfaces may be designed to securely hold the position members 114 and 124 in place while allowing for easy adjustment by the user.

In some embodiments, the adjustable interfaces 152 and 154 may include spring-loaded pins or other quick-release mechanisms to facilitate rapid adjustments of the bench angles. These mechanisms may be designed to be easily operated with one hand while supporting the weight of the seat or backrest portion with the other hand.

The frame 142 may include non-slip feet or pads at the contact points with the ground to prevent the bench from sliding during use. These feet may be adjustable to allow for leveling of the bench on uneven surfaces.

In some implementations, the frame 142 may incorporate additional features such as built-in weight plate storage pegs, resistance band attachment points, and/or other accessories to enhance the functionality of the weight bench 100.

The overall design of the base and frame 142 may be designed to provide a low center of gravity, enhancing the stability of the bench during use. The dimensions and proportions of the frame components may be selected to provide the necessary strength and support while maintaining a compact footprint for the bench.

C. A Hinge

The weight bench 100 may include a hinge 170 configured to connect to the support surface 102 and the base 140. The hinge 170 may be formed from a durable strong material, such as metal (e.g., stainless steel, composite steel, cast iron, etc.) and/or any other material capable of supporting the weight of the bench 100, a user, and weights (e.g., dumbbells, barbells, and/or other weighted objects a user may interact with).

The hinge 170 may define the axis of rotation 250. The axis of rotation 250 is outside the physical hinge 170, and is preferably located at a line where the upper surface 110 of the seat 104 and the upper surface 120 of the backrest portion 106 meet. In this way, the seat portion 104 and the backrest portion 106 may each rotate independently about the axis 250 without introducing a gap between the upper surfaces 110, 120. This configuration is made possible by defining two concentric arcs associated with the two portions of the support surface.

Figure 2:
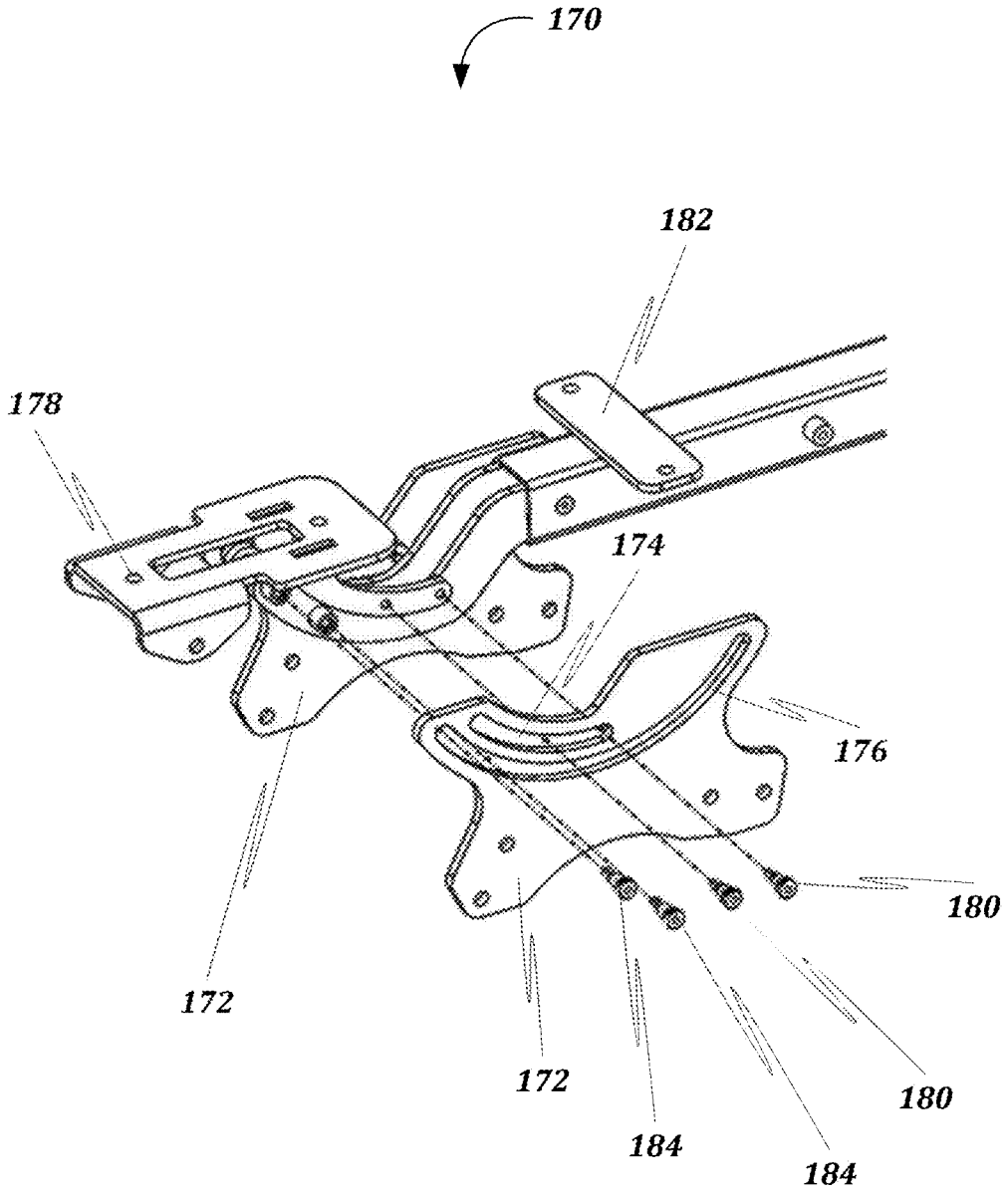
FIG. 2 is an exploded view of a first embodiment of a weight bench hinge as shown in FIG. 1.
Figure 3:
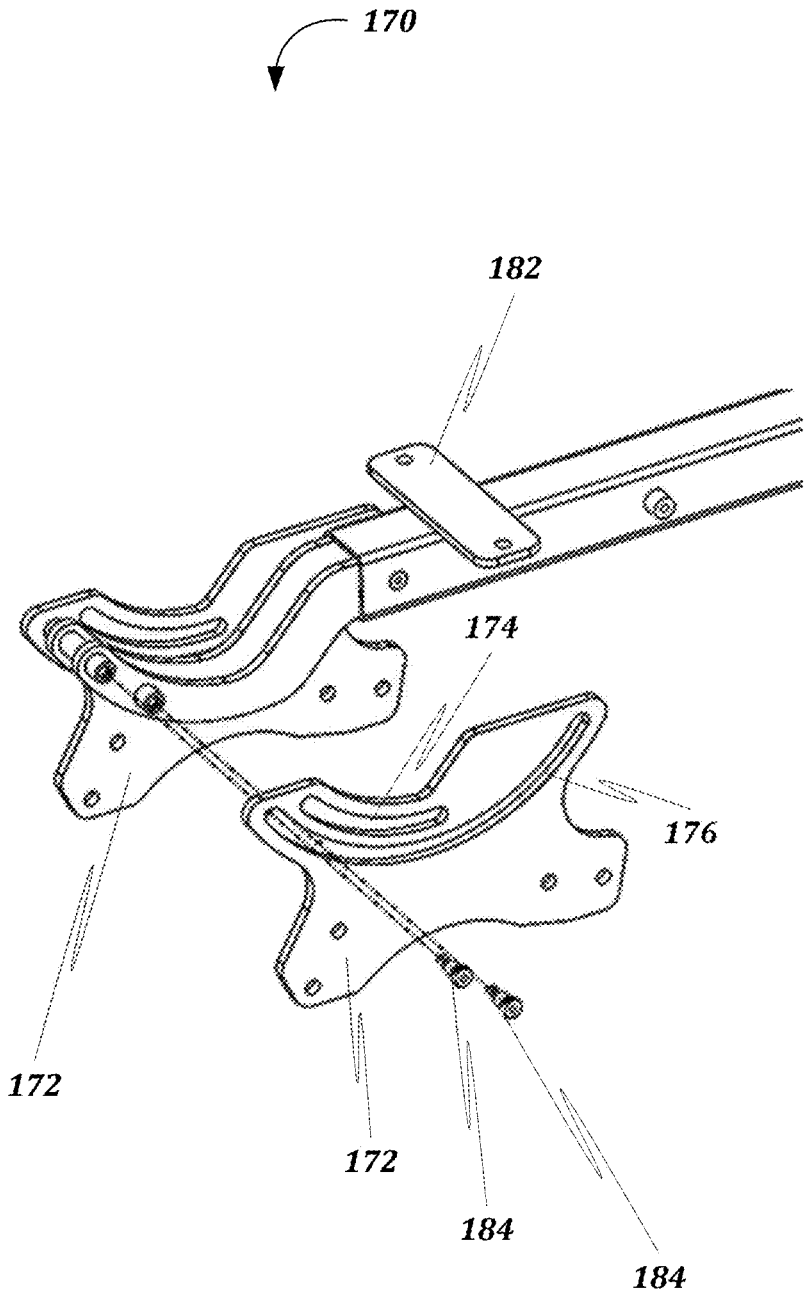
FIG. 3 is a second exploded view of the first embodiment of the weight bench hinge as shown in FIG. 1.
Figure 4:
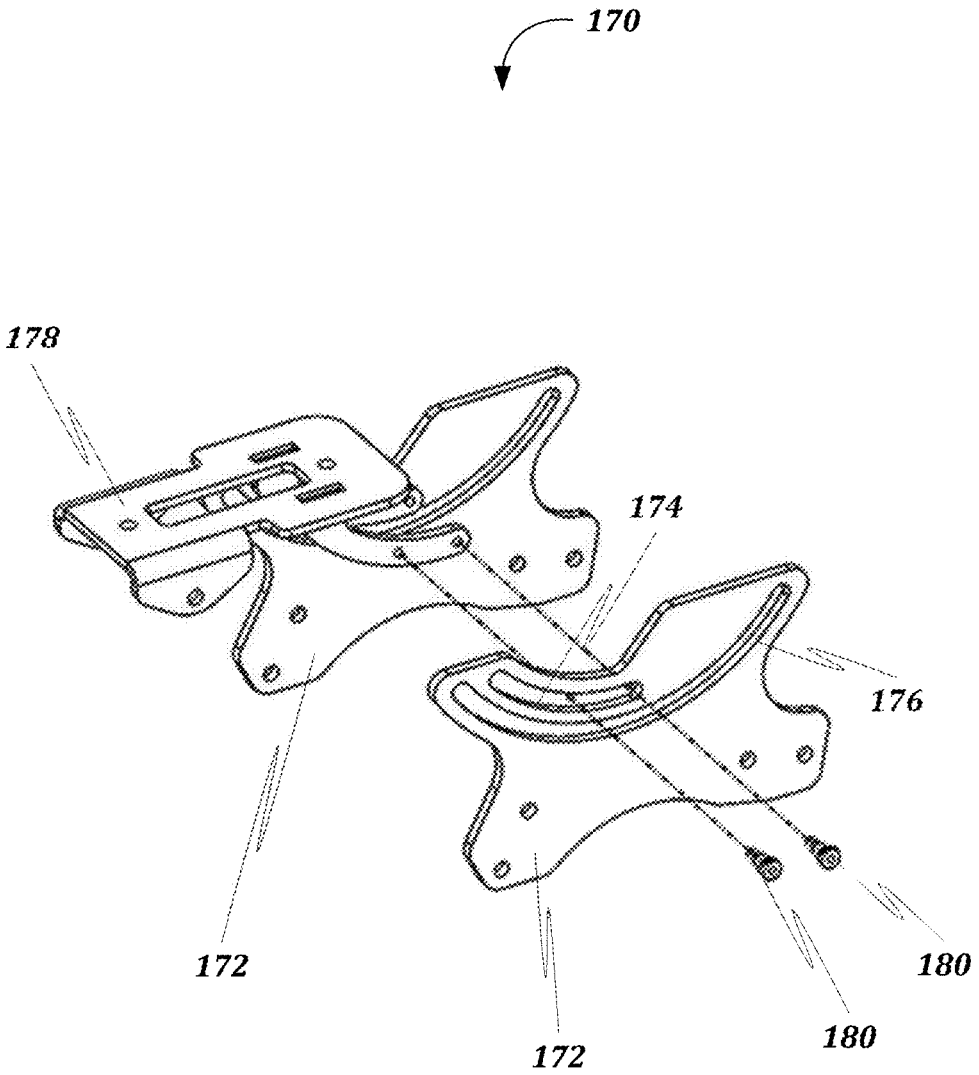
FIG. 4 is a third exploded view of the first embodiment of the weight bench hinge as shown in FIG. 1.
Figure 5:
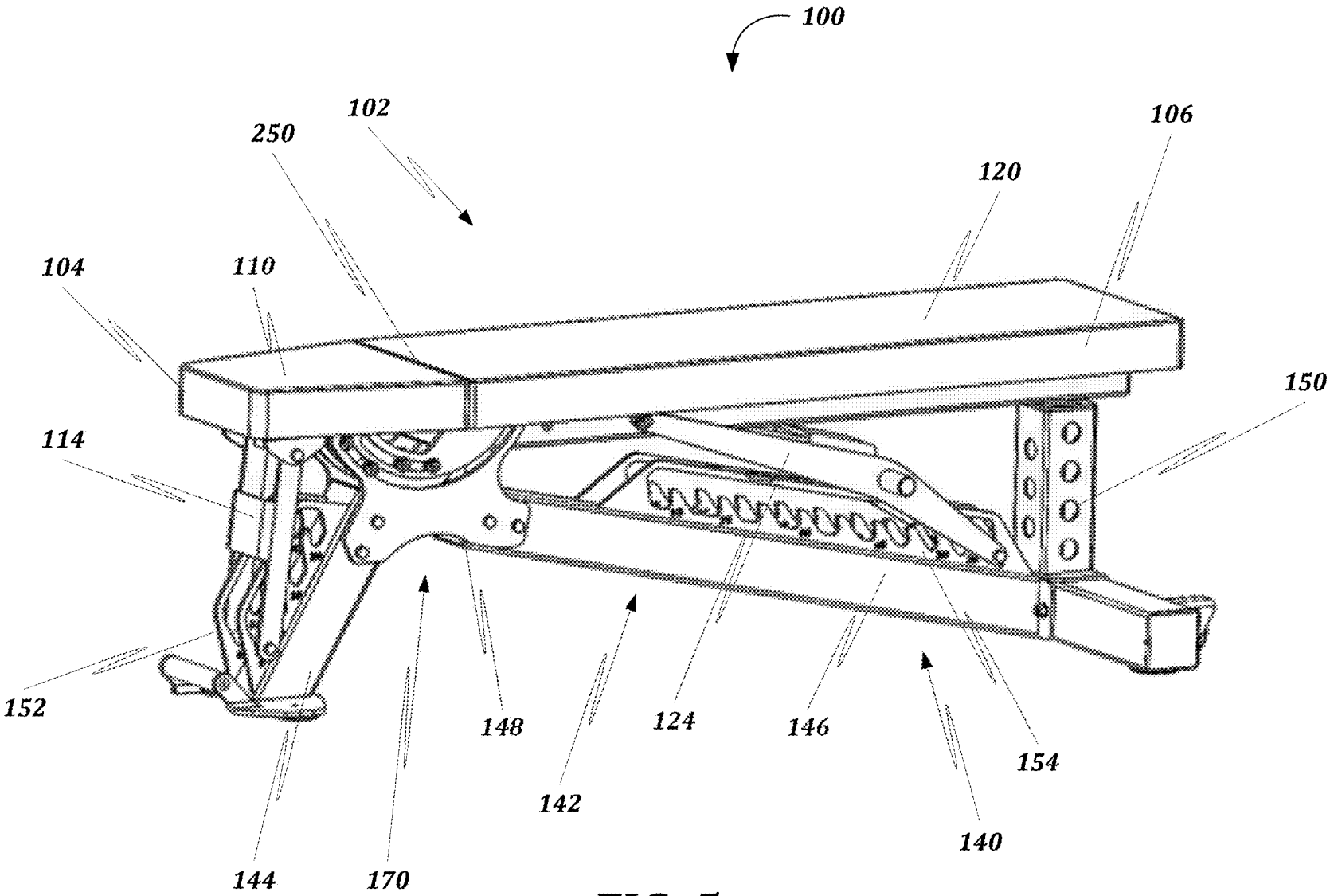
FIG. 5 is a perspective view of a weight bench having the first embodiment of the hinge design.

In some embodiments, as shown in FIGS. 2-10, and with particular attention to FIGS. 2-4, the hinge 170 may include one or more guide pieces 172 that are attached to the frame 140 (e.g., at the center portion 148). Each guide piece 172 may define a first arc 174 and a second arc 176. As discussed above, the arcs 174, 176 may be concentric, with center of the circle for each arc being the axis 250. The hinge 170 may include a seat interface 178 for attaching to the lower surface 112 of the seat portion 104. The seat interface 178 may include one or more first pins 180 for connecting the seat interface to the guide piece 172. That is, the one or more first pins may extend though the first arc 174 of the guide piece 172 to act as a first sliding limit hinge. In this way, the seat portion 104 is rotatably attached to the hinge 170 such that the seat portion can rotate about the axis 250. The hinge 170 may include a backrest interface 182 for attaching to the lower surface 122 of the backrest portion 106. The backrest interface 182 may include one or more second pins 184 for connecting the backrest interface to the guide piece 172 to act as a second sliding limit hinge. That is, the one or more second pins 184 may extend though the second arc 176 of the guide piece 172. In this way, the backrest portion 106 is rotatably attached to the hinge 170 such that the backrest portion can rotate about the axis 250.

Figure 11:
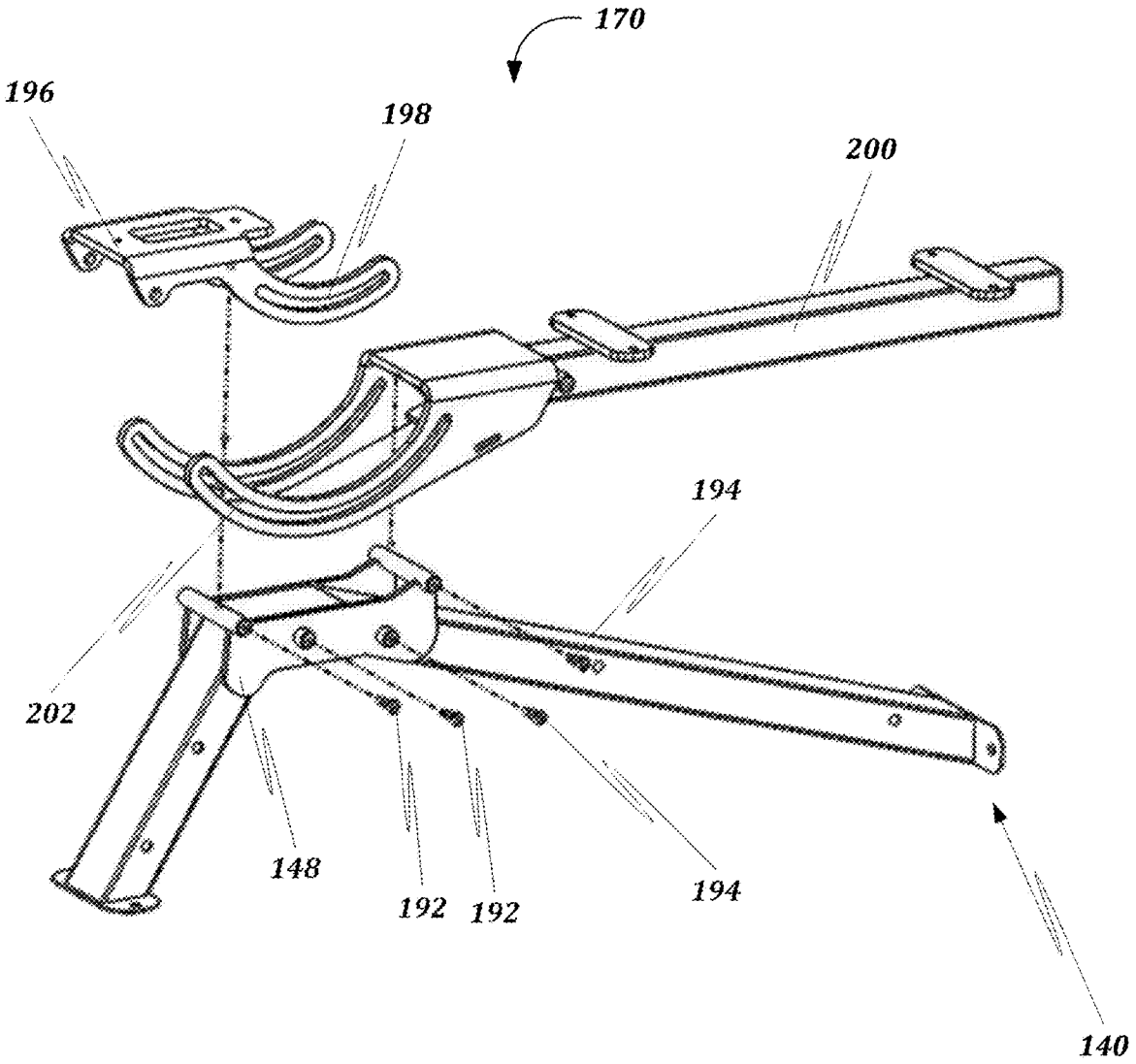
FIG. 11 is an exploded view of a second embodiment of a weight bench hinge as shown in FIG. 1.
Figure 12:
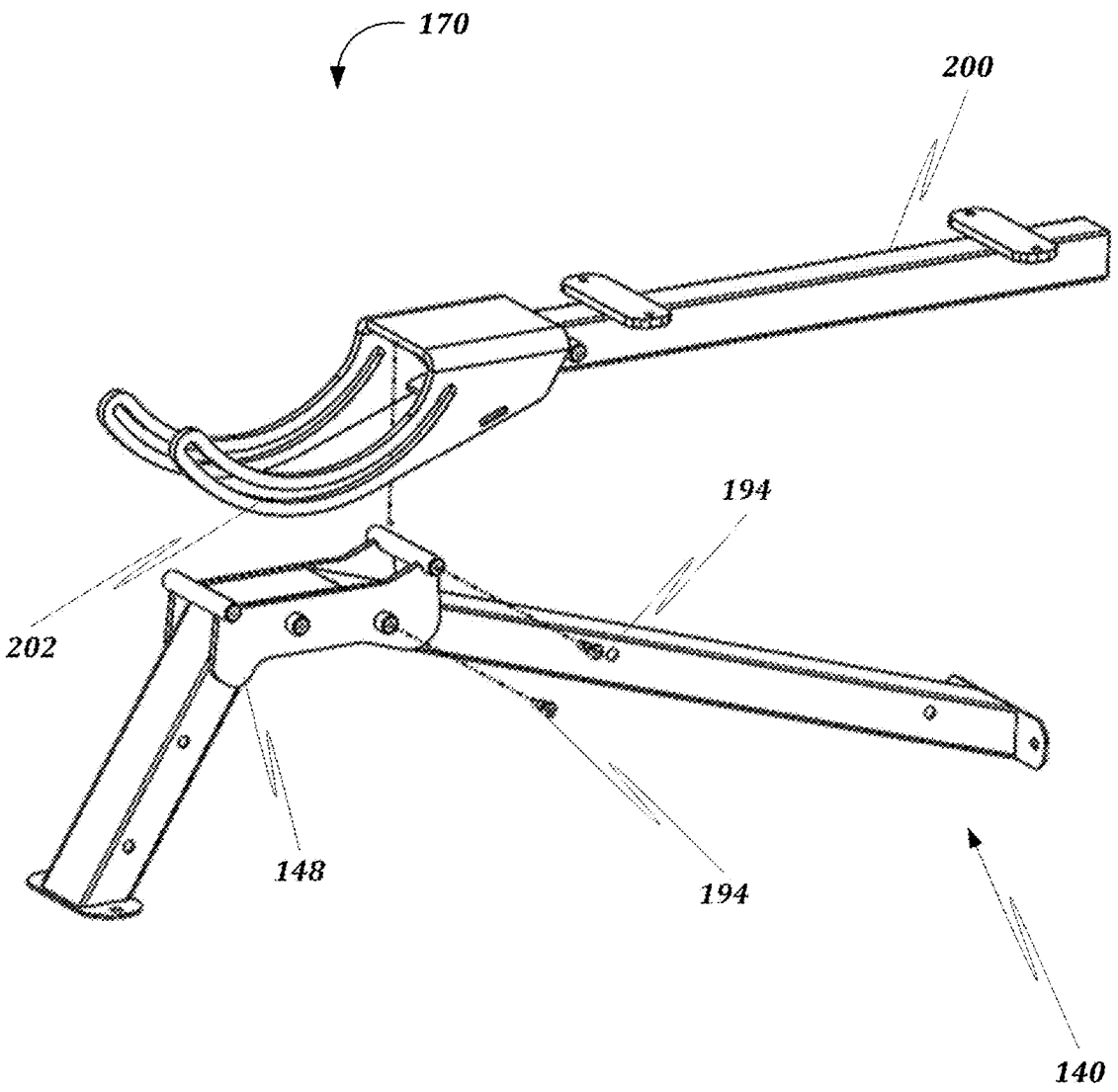
FIG. 12 is a second exploded view of the second embodiment of the weight bench hinge as shown in FIG. 1.
Figure 13:
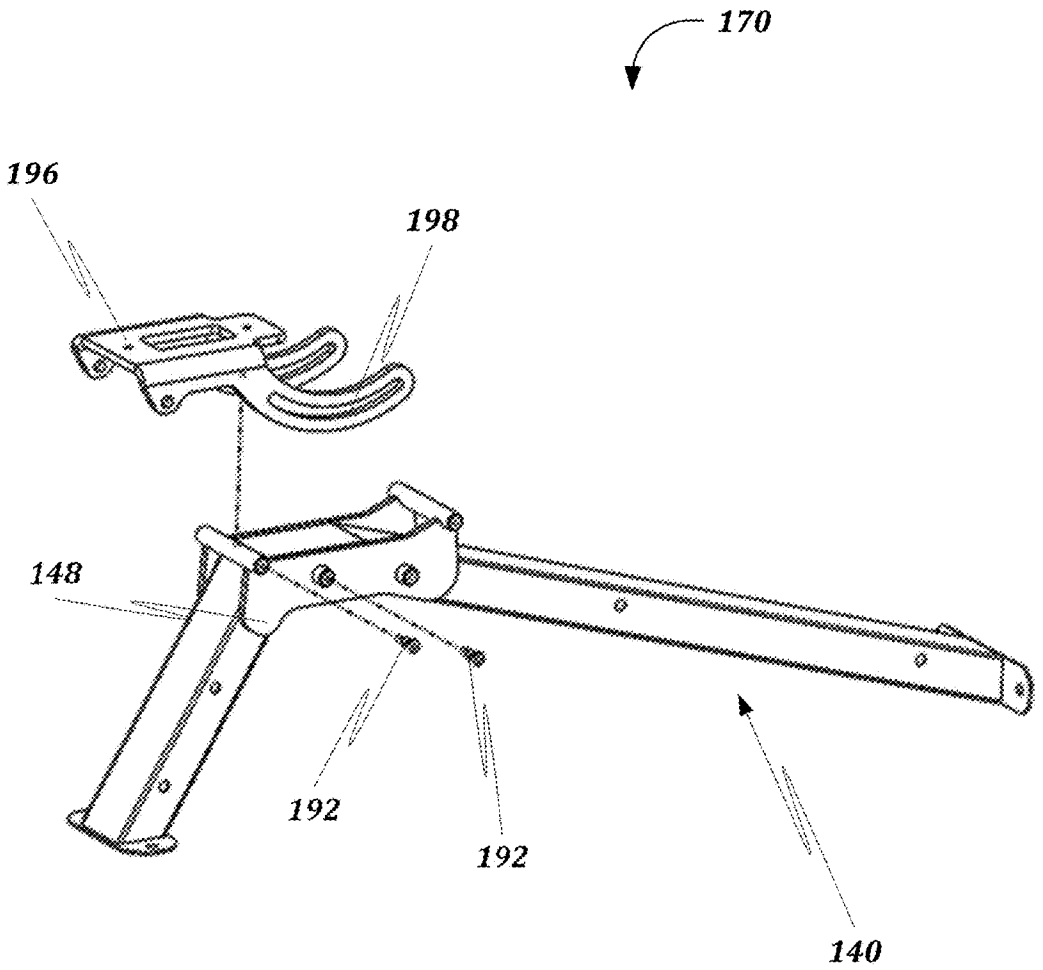
FIG. 13 is a third exploded view of the second embodiment of the weight bench hinge as shown in FIG. 1.
Figure 14:
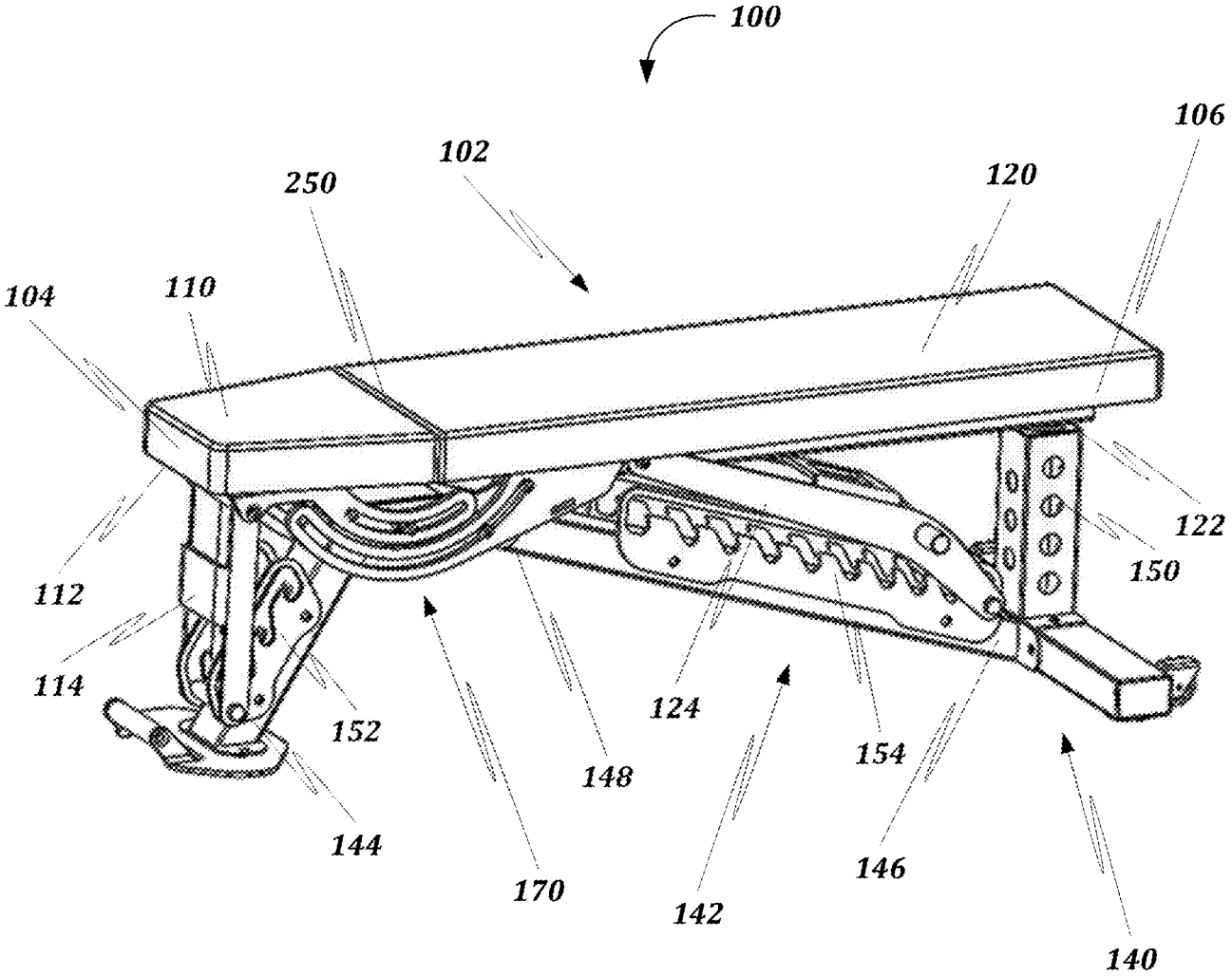
FIG. 14 is a perspective view of a weight bench having the second embodiment of the hinge design.
Figure 15:
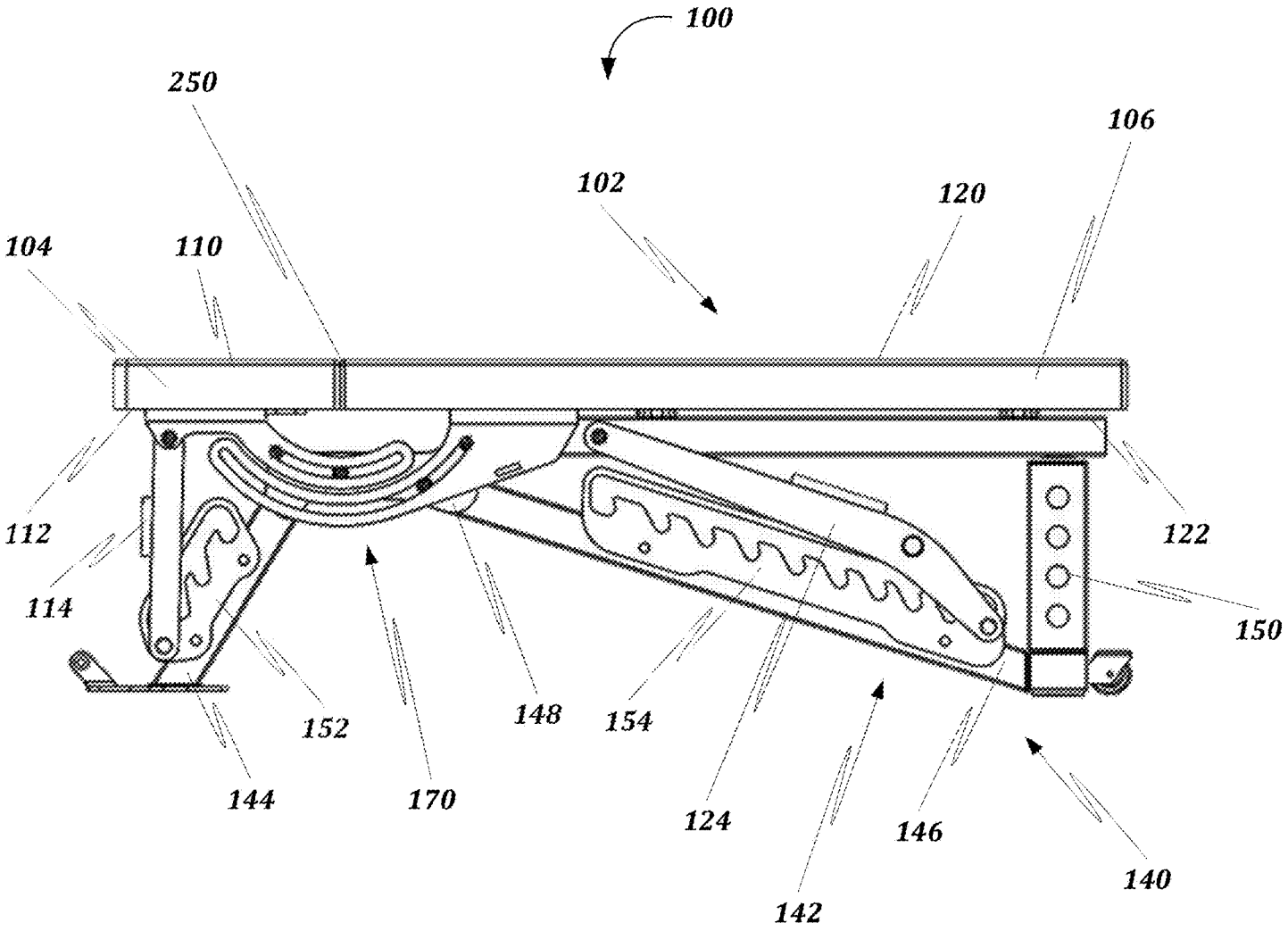
FIG. 15 is a profile view of the weight bench of FIG. 14 in a first position.
Figure 16:
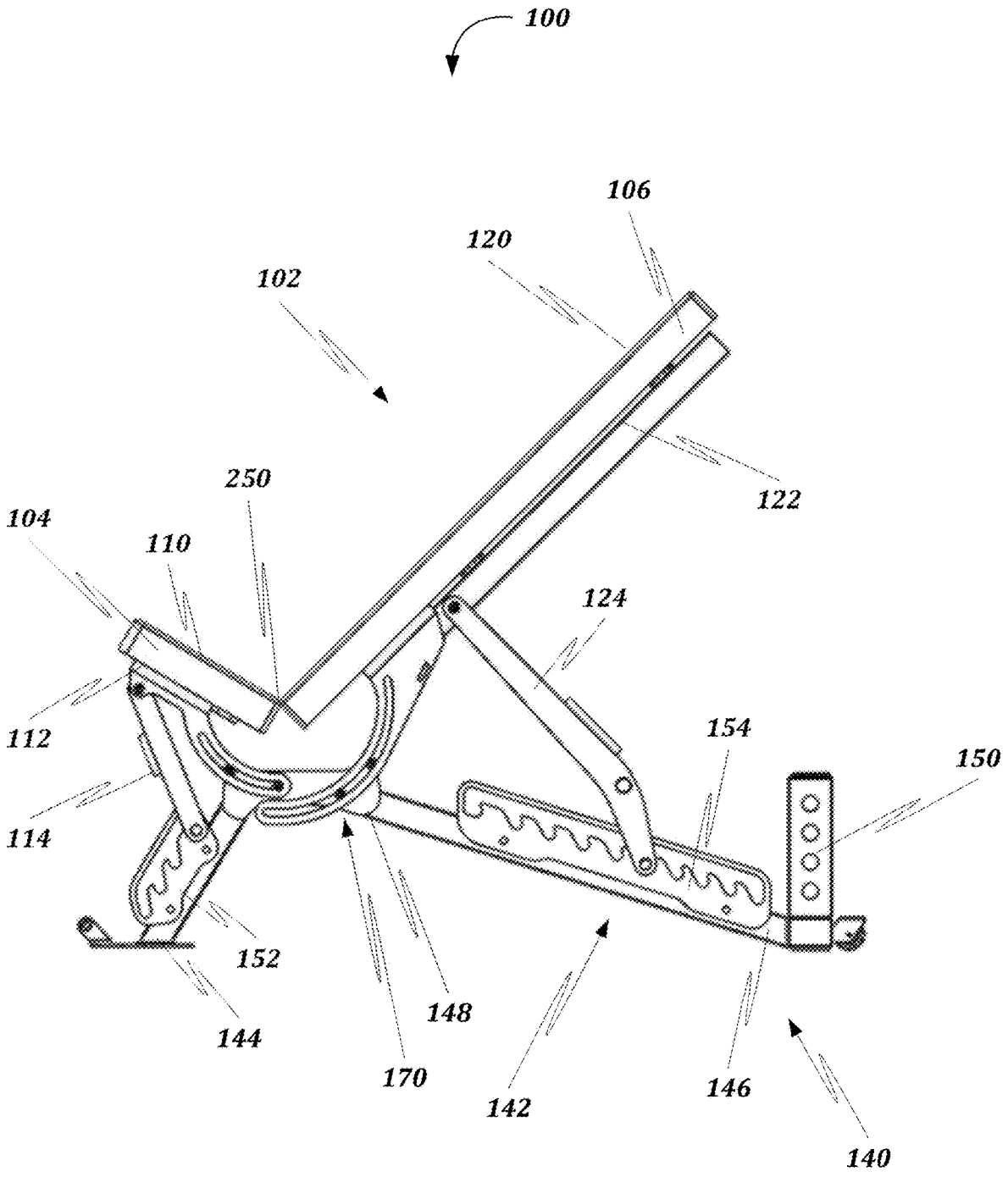
FIG. 16 is a profile view of the weight bench of FIG. 14 in a second position.

Alternatively, as shown in FIGS. 11-15, and with particular attention to FIGS. 11-13, a hinge 170 may include one or more first pins 192 and one or more second pins 194 fixedly connected to the base 140 (e.g., at the center portion 148). A seat interface 196 may be configured to be fixedly attached to the lower surface 112 of the seat portion 104. The seat interface may define a first arc 198. The first arc 198 may receive the first pins 192 to act as a first sliding limit hinge, such that the seat portion 104 is rotatably attached to the hinge 170. A backrest interface 200 may be configured to be fixedly attached to the lower surface 122 of the backrest portion 106. The backrest interface 200 may define a second arc 202. The second arc 202 may receive the second pins 194 to act as a second sliding limit hinge, such that the backrest portion 106 is rotatably attached to the hinge 170. The first arc 198 and second arc 202, when assembled on the hinge 170, may be sized such that the arcs are concentric, and the center of each arc may be a point along the axis 250, defined at the line with the top surfaces 110, 120 meet.

The hinge 170 may be formed from a durable strong material, such as metal (e.g., stainless steel, composite steel, cast iron, etc.) and/or any other material capable of supporting the weight of the bench 100, a user, and weights (e.g., dumbbells, barbells, and/or other weighted objects a user may interact with during weightlifting exercises). The hinge 170 may be configured to withstand repeated adjustments and use over an extended period of time.

In some embodiments, the hinge 170 may include one or more lubricating elements to facilitate smooth rotation of the seat portion 104 and backrest portion 106. These lubricating elements may include, but are not limited to, grease fittings, oil-impregnated bushings, or low-friction coatings applied to the sliding surfaces.

The hinge 170 may be designed to minimize play or wobble between the rotating components. This may be achieved through precise manufacturing tolerances and the use of adjustable components that allow for fine-tuning of the fit between parts.

In certain embodiments, the hinge 170 may incorporate safety features to prevent unintended movement or collapse of the bench 100. These safety features may include mechanical stops to limit the range of motion, locking mechanisms to secure the seat portion 104 and backrest portion 106 in place, redundant support structures, and/or the like.

The hinge 170 may be designed to be easily maintainable and serviceable. This may include features such as removable covers for access to internal components, modular design allowing for easy replacement of worn parts, or the use of standardized fasteners and components.

III. Platform Operation

Embodiments of the present disclosure provide a weight bench for use by a user. The following depicts an example of at least one method of a plurality of methods that may be performed by the user to operate the weight bench.

Although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones described below. Moreover, various stages may be added or removed from the without altering or departing from the fundamental scope of the depicted methods and systems disclosed herein.

Figure 17:
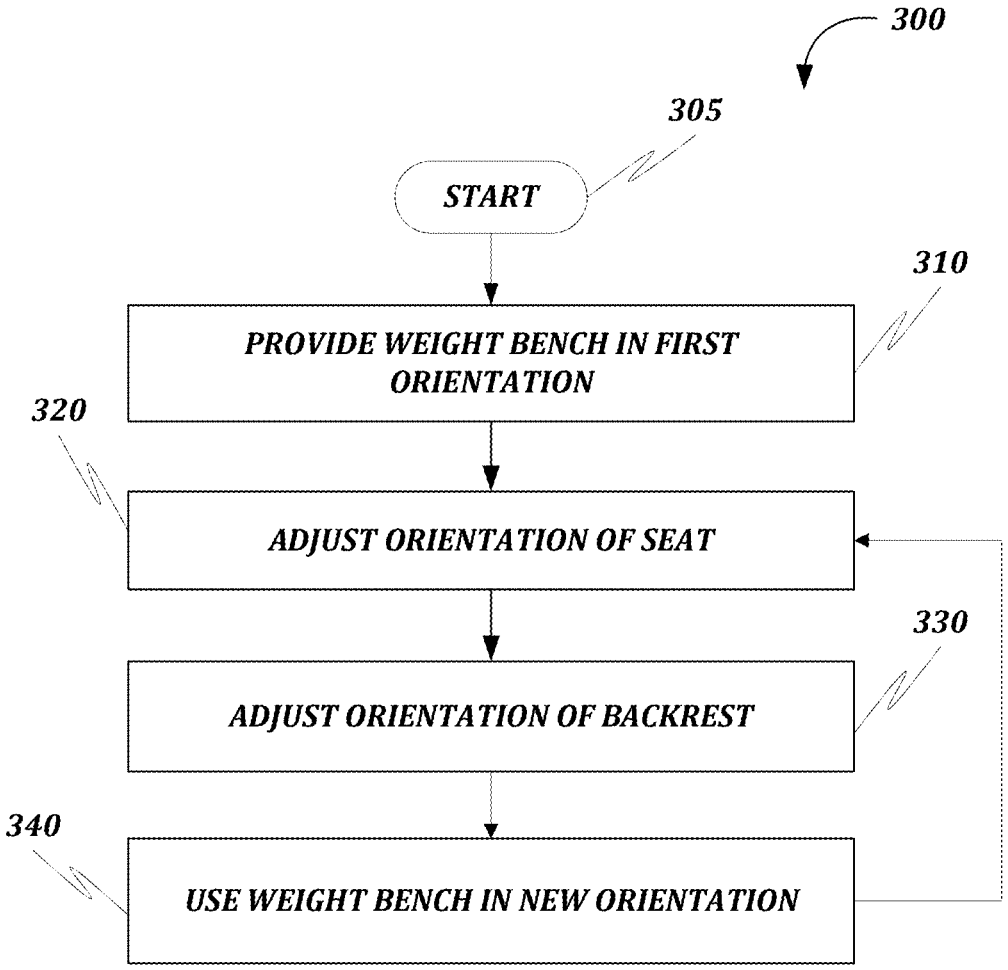
FIG. 17 is a flow chart of a method for providing the gapless hinge for adjustable weight bench.

FIG. 17 is a flow chart setting forth the general stages involved in a method 300 consistent with an embodiment of the disclosure for providing the weight bench 100. Method 300 may begin at starting block 305 and proceed to stage 310 where the weight bench 100 is provided in a starting orientation. The weight bench may include a support surface having a seat portion and a backrest portion. The seat portion and backrest portion may be configured to rotate about a common axis of rotation. The axis of rotation may be defined at a location where an upper surface of the seat portion meets an upper surface of the backrest portion.

Figure 6:
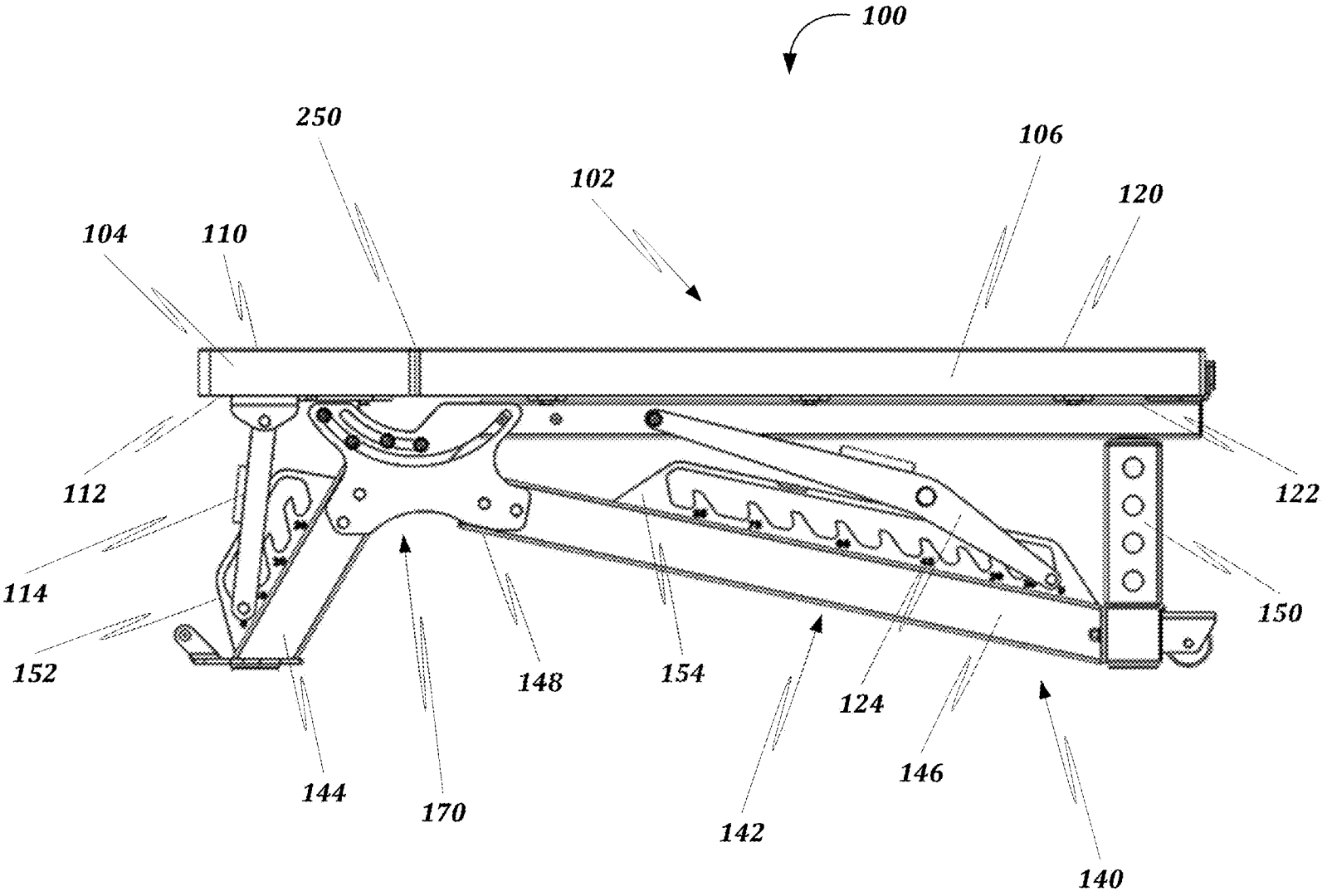
FIG. 6 is a profile view of the weight bench of FIG. 5 in a first position.
Figure 7:
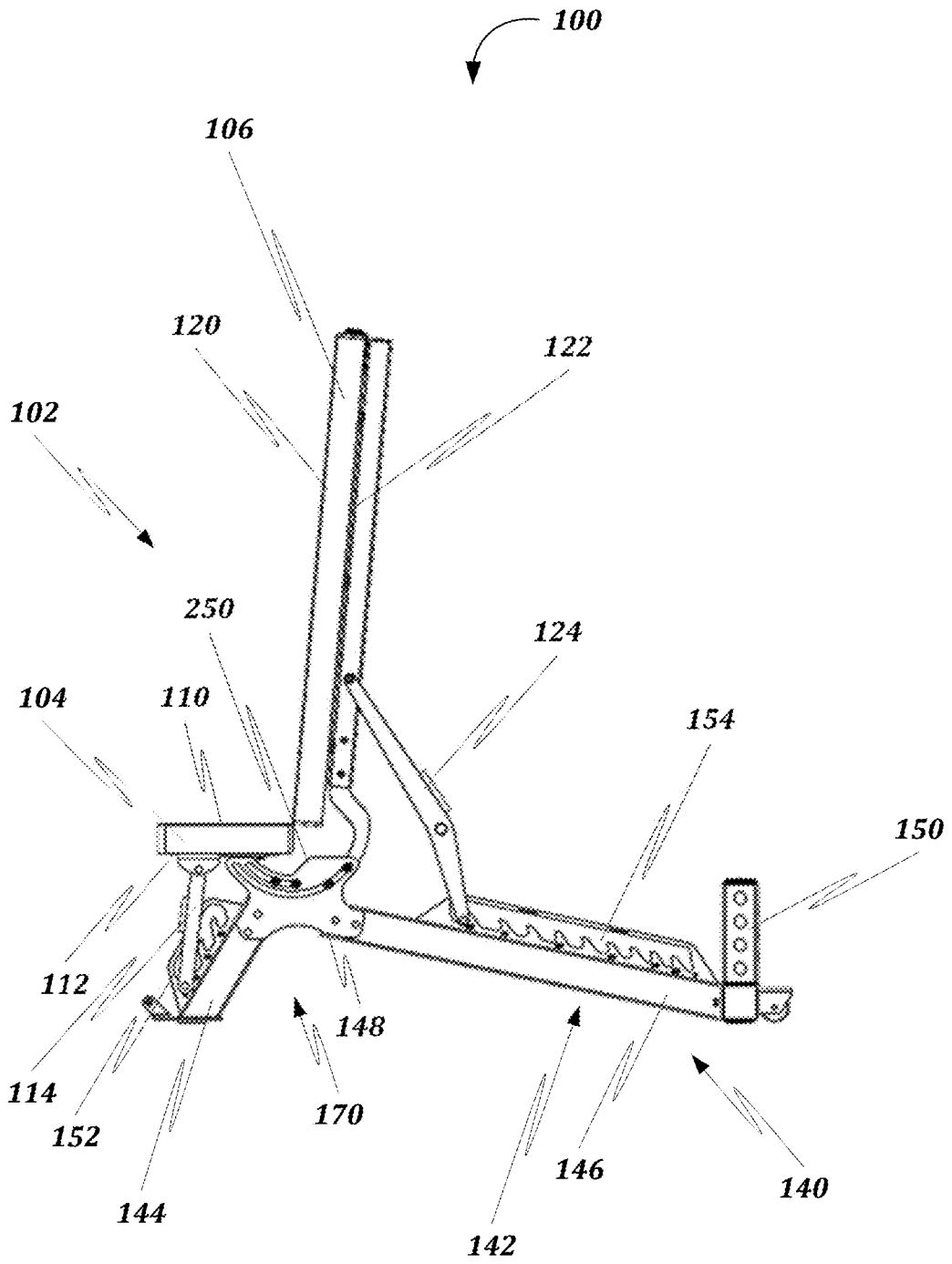
FIG. 7 is a profile view of the weight bench of FIG. 5 in a second position.
Figure 8:
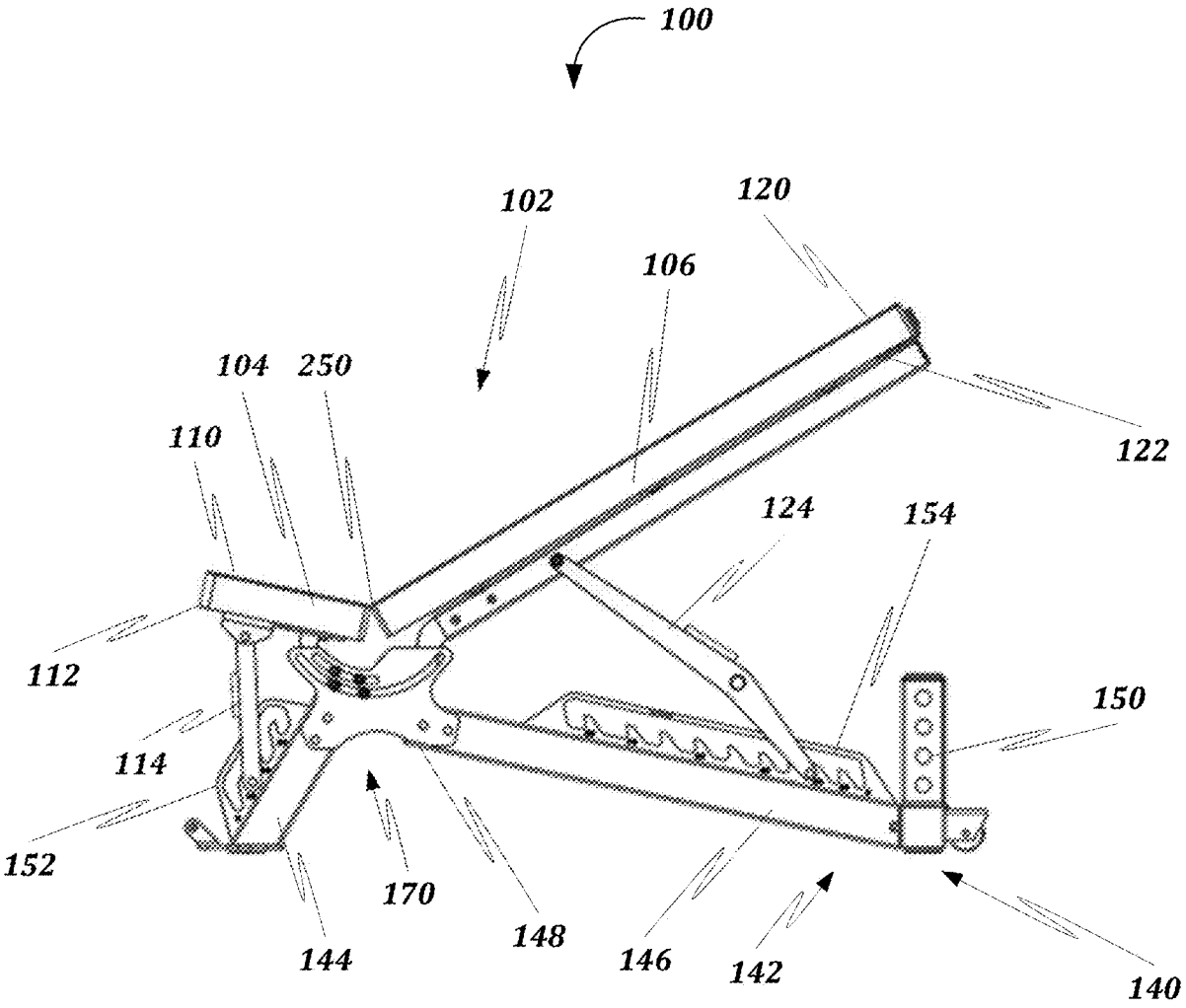
FIG. 8 is a profile view of the weight bench of FIG. 5 in a third position.
Figure 9:
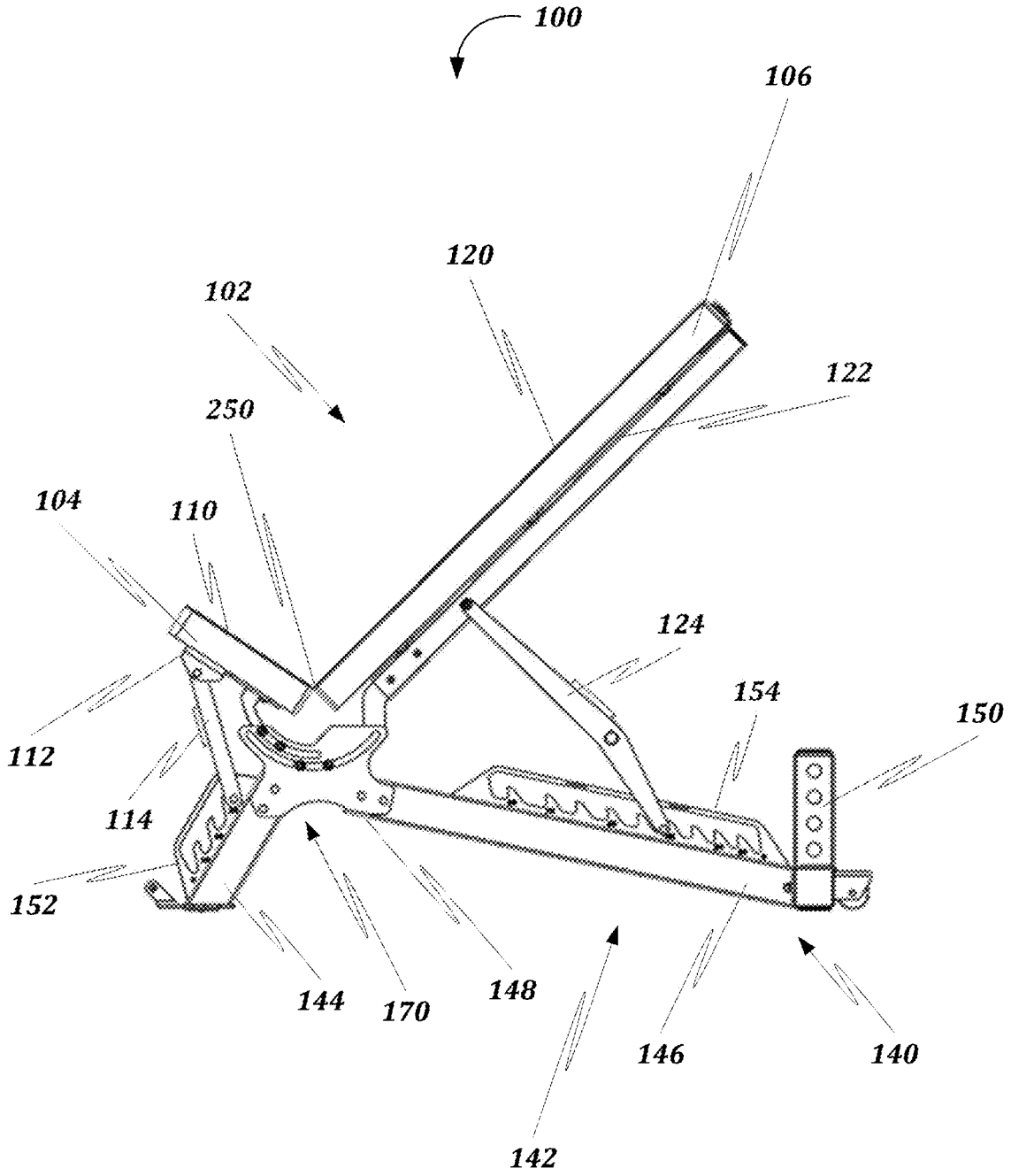
FIG. 9 is a profile view of the weight bench of FIG. 5 in a fourth position.
Figure 10:
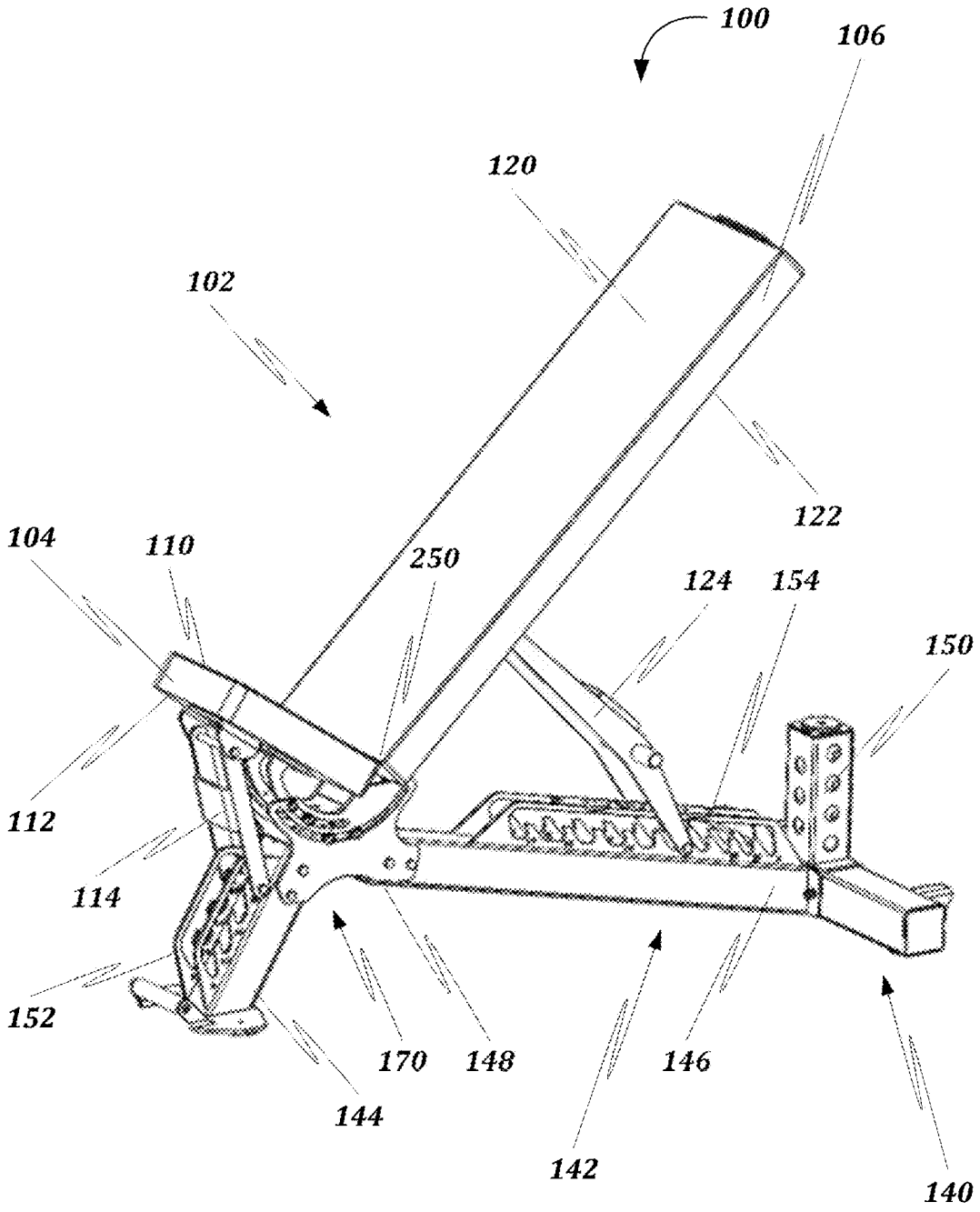
FIG. 10 is a perspective view of the weight bench of FIG. 5 in the fourth position.

As an example, the starting orientation may be a flat orientation (e.g., as shown in FIG. 6). Alternatively, the starting orientation may be any other orientation of the bench (e.g., the seat portion may be in any of the possible orientations about the axis 250, and the backrest may be in any of the possible orientations about the axis 250 as defined by the adjustable seat interface and the adjustable backrest interface, respectively). In embodiments, the seat portion and the backrest portion may be positioned such that there is substantially no gap between an upper surface of the seat portion and an upper surface of the backrest portion.

From stage 310, method 300 may advance to stage 320 where a user may adjust a position of the seat portion. This may involve moving a seat position member from a first position defined by an adjustable seat interface to a second position defined by the adjustable seat interface. This movement may cause the seat portion to rotate about the axis of rotation.

For example, the user may move the seat position member from a first position defined by the adjustable seat interface to a second position defined by the adjustable seat interface, causing the seat portion to rotate about an axis of rotation (e.g., the axis 250) defined by the location where the upper surface of the seat portion meets the upper surface of the backrest portion.

In stage 330, a user may adjust a position of the backrest portion. This may involve moving a backrest position member from a first position defined by an adjustable backrest interface to a second position defined by the adjustable backrest interface. This movement may cause the backrest portion to rotate about the same axis of rotation.

For example, the user may move the backrest position member from a first position defined by the adjustable backrest interface to a second position defined by the adjustable backrest interface, causing the backrest portion to rotate about the same axis (e.g., the axis 250).

Those of skill in the art will appreciate that stages 320 and 330 may be performed in either order, or may be performed contemporaneously. In this way, both the seat portion and the backrest portion rotate about the same axis 250, such that there is no change to a size of the gap between the upper surfaces of the seat portion and the backrest portion. That is, in all orientations of the seat portion and the backrest portion, there is substantially no gap between the upper surface of the seat portion and the upper surface of the backrest portion.

The seat portion and backrest portion may rotate independently about the common axis of rotation. This independent rotation may maintain substantially no gap between the upper surface of the seat portion and the upper surface of the backrest portion in all orientations.

Once the seat portion and the backrest portion are adjusted in stages 320 and 330, method 300 may continue to stage 340 where the user may make use of the weight bench. For example, the user may sit and/or lay on the support surface to perform one or more exercise motions.

After adjusting the seat and backrest portions, the method may include using the weight bench in the new orientation. For example, a user may sit or lay on the support surface to perform one or more exercise motions.

After stage 340, method 300 may return to stage 320 where seat may be adjusted again.

The method may allow for readjusting the positions of the seat portion and backrest portion as desired. The user may repeat the steps of adjusting the seat and backrest portions to achieve different configurations of the weight bench.

The following is claimed:

1. A weight bench comprising:

a frame;

a seat portion;

a hinge connecting the seat portion to the frame, such that the seat portion is rotatable between a flat position and an inclined position;

a backrest portion mounted to the frame using the hinge, such that the backrest portion is rotatable between a flat position and an inclined position;

wherein the backrest portion and the seat portion are mounted to the frame by the hinge such that a peripheral edge of an upper surface of the seat portion substantially abuts a peripheral edge of an upper surface of the backrest portion to define a common axis, such that a gap distance between the seat portion and the backrest portion is approximately zero;

wherein the hinge comprises:

a first sliding limit hinge configured to allow the seat portion to rotate about the common axis, and a second sliding limit hinge configured to allow the backrest portion to rotate about the common axis;

wherein the first sliding limit hinge maintains the gap distance between the seat portion and the backrest portion at a constant width as the seat portion rotates between the flat position and the inclined position, and wherein the second sliding limit hinge maintains the gap distance between the seat portion and the backrest portion at a constant width as the backrest portion rotates between the flat position and the inclined position.

2. The weight bench of claim 1, wherein the hinge further comprises:

one or more guide pieces attached to the frame, each guide piece defining a first arc and a second arc;

a seat interface attached to a lower surface of the seat portion, the seat interface comprising one or more first pins extending through the first arc of the guide piece to form the first sliding limit hinge; and a backrest interface attached to a lower surface of the backrest portion, the backrest interface comprising one or more second pins extending through the second arc of the guide piece to form the second sliding limit hinge.

3. The weight bench of claim 2, wherein the first arc and the second arc are concentric, with a center of each arc being located at the common axis.

4. The weight bench of claim 1, wherein the hinge further comprises:

one or more first pins and one or more second pins fixedly connected to the frame;

a seat interface attached to a lower surface of the seat portion, the seat interface defining a first arc that receives the one or more first pins to form the first sliding limit hinge; and a backrest interface attached to a lower surface of the backrest portion, the backrest interface defining a second arc that receives the one or more second pins to form the second sliding limit hinge.

5. The weight bench of claim 4, wherein the first arc and the second arc are concentric when assembled on the hinge, with a center of each arc being located at the common axis.

6. The weight bench of claim 1, further comprising:

a seat position member attached to the seat portion; and an adjustable seat interface on the frame configured to receive and retain the seat position member in a plurality of positions corresponding to different rotational orientations of the seat portion about the common axis.

7. The weight bench of claim 1, further comprising:

a backrest position member attached to the backrest portion; and an adjustable backrest interface on the frame configured to receive and retain the backrest position member in a plurality of positions corresponding to different rotational orientations of the backrest portion about the common axis.

8. A method for adjusting a weight bench, the method comprising:

providing a weight bench comprising:

a frame, a seat portion mounted to the frame using a hinge, and a backrest portion mounted to the frame using the hinge, wherein the hinge defines a common axis of rotation for the seat portion and the backrest portion;

adjusting a position of the seat portion by rotating the seat portion about the common axis; and adjusting a position of the backrest portion by rotating the backrest portion about the common axis;

wherein a gap distance between an upper surface of the seat portion and an upper surface of the backrest portion remains substantially constant during adjustment of the seat portion and the backrest portion.

9. The method of claim 8, wherein adjusting the position of the seat portion comprises:

moving a seat position member attached to the seat portion from a first position defined by an adjustable seat interface on the frame to a second position defined by the adjustable seat interface.

10. The method of claim 8, wherein adjusting the position of the backrest portion comprises:

moving a backrest position member attached to the backrest portion from a first position defined by an adjustable backrest interface on the frame to a second position defined by the adjustable backrest interface.

11. The method of claim 8, wherein the hinge comprises:

a first sliding limit hinge that allows the seat portion to rotate about the common axis; and a second sliding limit hinge that allows the backrest portion to rotate about the common axis.

12. The method of claim 11, wherein:

the first sliding limit hinge maintains the gap distance between the seat portion and the backrest portion at a constant width as the seat portion rotates, and the second sliding limit hinge maintains the gap distance between the seat portion and the backrest portion at a constant width as the backrest portion rotates.

13. The method of claim 8, wherein the gap distance is substantially zero.

14. A hinge system for an adjustable weight bench, the hinge system comprising:

a frame attachment portion configured to attach to a frame of a weight bench;

a seat attachment portion configured to attach to a seat of the weight bench;

a backrest attachment portion configured to attach to a backrest of the weight bench;

a first sliding limit hinge connecting the frame attachment portion to the seat attachment portion; and a second sliding limit hinge connecting the frame attachment portion to the backrest attachment portion;

wherein the first sliding limit hinge and the second sliding limit hinge define a common axis of rotation for the seat and the backrest, the common axis being located at a point where an upper surface of the seat meets an upper surface of the backrest when the hinge system is assembled on a weight bench.

15. The hinge system of claim 14, wherein the first sliding limit hinge comprises:

a first arc-shaped track defined by one of the frame attachment portion or the seat attachment portion; and one or more first pins attached to the other of the frame attachment portion or the seat attachment portion, the one or more first pins configured to slide within the first arc-shaped track.

16. The hinge system of claim 15, wherein the second sliding limit hinge comprises:

a second arc-shaped track defined by one of the frame attachment portion or the backrest attachment portion; and one or more second pins attached to the other of the frame attachment portion or the backrest attachment portion, the one or more second pins configured to slide within the second arc-shaped track.

17. The hinge system of claim 16, wherein the first arc-shaped track and the second arc-shaped track are concentric, with a center of each arc-shaped track being located at the common axis of rotation.

18. The hinge system of claim 14, further comprising:

a seat position member attached to the seat attachment portion; and an adjustable seat interface on the frame attachment portion configured to receive and retain the seat position member in a plurality of positions corresponding to different rotational orientations of the seat about the common axis.

19. The hinge system of claim 14, further comprising:

a backrest position member attached to the backrest attachment portion; and an adjustable backrest interface on the frame attachment portion configured to receive and retain the backrest position member in a plurality of positions corresponding to different rotational orientations of the backrest about the common axis.

20. The hinge system of claim 14, wherein the first sliding limit hinge and the second sliding limit hinge are configured to maintain a substantially constant gap distance between the seat and the backrest as they rotate about the common axis.

* * * * *